US005390574A

United States Patent [19]

Schorn

[11] Patent Number: 5,390,574

[45] Date of Patent: Feb. 21, 1995

[54] CONTROL FOR AUTOMATICALLY PROGRAMMED VARIABLE PUMP OUTPUT PRESSURE OF A HYDRAULICALLY OPERATED PUNCH PRESS

[76] Inventor: Gerard J. Schorn, 1317 Rosebud Rd., Southhampton, Pa. 18966

[21] Appl. No.: 992,969

[22] Filed: Dec. 15, 1992

[51] Int. Cl.[6] ..... B26D 5/12; B30B 15/16

[52] U.S. Cl. ..... 83/76.1; 83/76.9; 83/639.1; 72/7; 100/269 R

[58] Field of Search ..... 83/76.1, 76.6, 76.9, 83/639.1; 417/269, 222.1, 222.2; 72/7; 100/269 R

[56] References Cited

U.S. PATENT DOCUMENTS 4,116,122 9/1978 Linder et al. ..... 100/48

5,031,431 7/1991 Naito ..... 72/7

*Primary Examiner*—Richard K. Seidel

*Assistant Examiner*—Raymond D. Woods

*Attorney, Agent, or Firm*—John R. Benefiel

[57] ABSTRACT

A punch press having automated punching programs executed by a hydraulic cylinder operating a punch ram, in which a pump used to generate hydraulic pressure for a ram cylinder is adjusted to an output corresponding to a calculation of the minimum pump pressure required to completely execute the program. The workpiece material and tool characteristic data is contained in data storage tables and utilized in calculating the minimum pressure required.

3 Claims, 1 Drawing Sheet

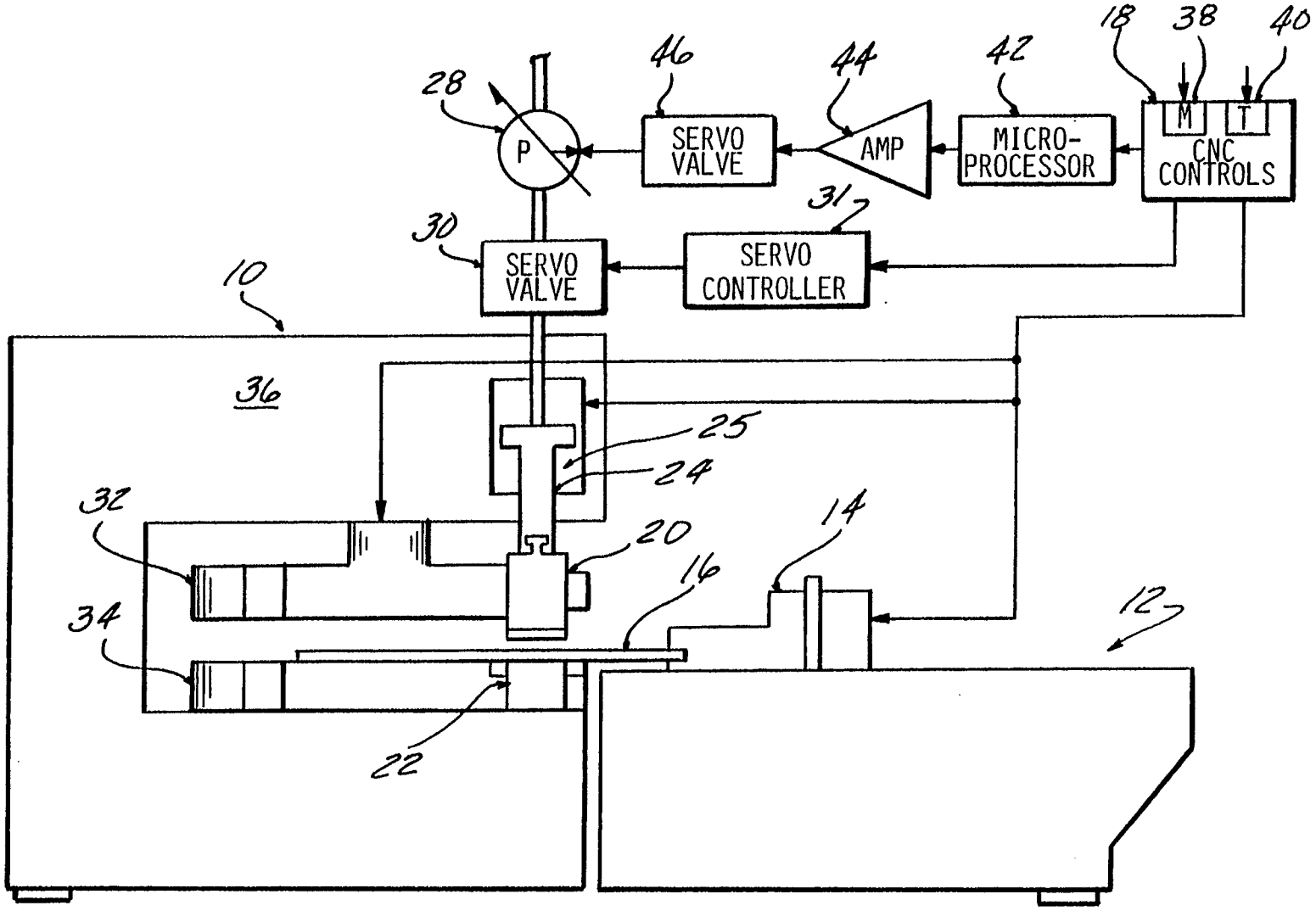
CNC CONTROLS
M
T
MICRO-PROCESSOR
AMP
SERVO VALVE
SERVO CONTROLLER
SERVO VALVE
P
10
12
14
16
18
20
22
24
25
28
30
31
32
34
36
38
40
42
44
46

CONTROL FOR AUTOMATICALLY PROGRAMMED VARIABLE PUMP OUTPUT PRESSURE OF A HYDRAULICALLY OPERATED PUNCH PRESS

BACKGROUND OF THE INVENTION

This invention concerns automatically controlled punch presses for forming holes in sheet material workpieces.

In recent years, punch presses have become highly automated, with CNC control over tool selection and positioning of the workpiece in the press to execute a programmed series of punching and forming operations on a sheet material workpiece.

Another trend is to provide a hydraulically operated press ram in order to enable sophisticated control over the punching process, as for example to precisely variably control the punch velocity so as to minimize cycle time and punching noise.

Such hydraulically operated ram presses are equipped with a hydraulic pump designed to supply a flow of sufficiently high pressure fluid to enable execution of the heaviest tonnage punching requirements of which the machine is capable. During execution of the punching program, the pump is normally run at maximum output, regardless of the tonnage requirements of the particular program.

The tonnage required is dependent on the tool size and shape characteristics, as well as the thickness of the workpiece material and its shear strength.

Running the pump at its highest output level is costly in terms of power consumption and increased maintenance of the pump seals, etc, and increased generation of heat and noise is a disadvantage.

Most punching programs do not require the maximum press tonnage to execute. While manual reduction of the pump output for a given program is a possibility, this would increase the difficulty and time required in operating the press and also cause an increase in the possibility of errors in setting up for a programmed production run.

The object of the present invention is to provide a pump output control for hydraulic ram press to reduce the pump output when possible and without requiring the necessity for operator intervention.

SUMMARY OF THE INVENTION

The above recited object is achieved by a control arrangement in which the pump output level is automatically adjusted in correspondence with an analysis of the tool selection program and material thickness and shear strength data input from data storage tables in the CNC controller, as well as of system configuration factors relating to the ram cylinder size and hydraulic system loss characteristics.

The analysis utilizes an algorithm for calculating the maximum pump pressure, applied to program parameter data consisting of the product of tool size and characteristic factors, material thickness and shear strength factors, divided by the ram cylinder effective area, minus the pressure loss characteristics of the hydraulic system.

An electrical analog control signal is generated by use of the algorithm, which control signal is then utilized as with a servo valve to automatically reduce the pump output pressure for any particular program which does not require maximum press tonnage at any time to a level in correspondence with the calculated minimum pump pressure required to complete execution of a particular program.

The level of pump output pressure is thus programmed automatically for each production program without the need for operator intervention, realizing savings in power consumption, pump maintenance, and reducing the heat and noise produced by press operation.

DESCRIPTION OF THE DRAWINGS

The Figure is a schematic representation of a hydraulic ram punch press with associated controls according to the present invention.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the Figure, a press 10 and associated worktable 12 are depicted schematically.

The worktable 12 includes a traversing gripper mechanism 14 adapted to move a workpiece 16 according to the program stored in the CNC controller 18 so as to position a portion of the workpiece to be punched beneath punch and die tooling 20, 22 located at the punching station in the press 10.

The punching station is defined by a press ram 24 adapted to be driven by a hydraulic cylinder 25, supplied by a variable output pump 28 and servo controller 31 and servo valve 30.

The punch and die tooling is mounted in respective upper and lower turrets 32, 34 mounted within the throat of the press frame 36 which are rotated under the control of the CNC controller 18 to bring any of a plurality of punch and die sets into the punching station.

The ram hydraulic cylinder 25 may be controlled with the servo controller 31 so as to maintain a desired punching velocity pattern, as to control noise.

Such an arrangement is described in copending U.S. patent application Ser. No. 07/819,322 filed on Jan. 14, 1992, for a "Method and System for Controlling Punch Noise", now U.S. Pat. No. 5,299,478 issued on Apr. 5, 1994.

For other arrangements see also U.S. Pat. No. 4,823,658 issued Apr. 25, 1989, for "Punch Presses"; U.S. Pat. No. 5,031,431 issued Jul. 16, 1991, for a "Method and Device for Controlling the Stroke of a Press machine"; U.S. Pat. No. 5,027,631 issued Jul. 2, 1991, for a "Method and Device for controlling the Stroke of a Press Machine"; and U.S. Pat. No. 4,208,935 issued Jun. 24, 1980, for a "Control System for a Hydraulic Press".

The CNC controller 18 contains data tables diagrammatically represented by 38, 40 corresponding to the material and tooling loaded in the turrets 32, 34. The table 38 may be manually loaded for all materials to be punched by the machine including data for each of the various material thicknesses and shear strengths anticipated as being punched in the press.

The tooling table contains tooling data for each tool to be used on the machine, with data specifying the tool size (circumference) and a shear factor, i.e., data relating the relative pressure required for punching with a particular punch geometry, in addition to the tool circumference.

The CNC controller 18 also has stored data on the ram cylinder size and loss characteristics of the associated hydraulic system.

For each program to be executed by the CNC controller, the material and tooling data is specified by the program.

According to the concept of the present invention, a suitably programmed microprocessor 42 receives and reviews the program material and tooling data for a given production punching program, and using a suitable algorithm, generates a pump pressure control signal from a calculation of the peak tonnage required during running of the particular punching operation program, and the corresponding peak ram cylinder tonnage.

This algorithm is according to the form:

$P=[(c \cdot t \cdot r \cdot s)/A]+pa$ where P=minimum system hydraulic pressure required to completely execute the particular punching program;

c=circumference of the tool;

t=material thickness;

r=material shear strength;

s=tool shear factor;

A=area of the ram cylinder;

pa=system pressure loss factor

The minimum tonnage required determines if the pump 28 can be run at a reduced output for the particular program.

A suitable amplifier 44 amplifies the control signal and transmits the same to a servo valve 46 which causes adjustment of the output pressure of the pump 28.

Thus, for example, if the maximum system pressure is 4600 psi, and the given program requires only 2300 psi to develop the ram tonnage required, the control signal would set a pump output equal to 50% of maximum during running of the particular program.

This calculation and control could also be carried out in the CNC controller 18.

I claim:

1. A punch press for programmably performing a series of punching operations on a sheet material workpiece, comprising:

a punch press frame forming a throat opening;

a press ram mounted for vertical movement on said frame at a punching station;

an upper turret rotatably driven on said press frame within said throat opening, said upper turret having a circumference, and a plurality of diverse punching tools carried by said upper turret arranged about said circumference of said upper turret;

a lower turret rotatably driven on said press frame within said throat opening aligned with said upper turret, said lower turret having a circumference and a plurality of diverse dies carried by said lower turret arranged about said circumference of said lower turret and corresponding to said plurality of punching tools;

a workpiece gripper transport mechanism for positioning a selected location on said sheet material workpiece at said punching station;

a hydraulic cylinder coupled to said press ram to enable actuation of said press ram vertical movement;

a variable output pressure pump connected to said hydraulic cylinder to enable pressurizing said hydraulic cylinder for actuation of said ram, said pump capable of producing a predetermined maximum output pressure;

means for controllably adjusting the output pressure of said pump for supplying said hydraulic ram with pressurized fluid at a predetermined pressure;

controller means for automatic operation of said press, carrying out a sequence of punching operations, according to a punching program, said controller means associated with said workpiece gripper transport mechanism, said hydraulic cylinder, and said upper and lower turrets to cause a selected punch and die to be positioned at said punching station aligned with a particular location on said workpiece, to carry out a punching operation thereon by actuation of said hydraulic cylinder, said controller means including data storage tables having data stored thereon corresponding to the shear strength and thickness of the material of said workpiece and of a shear factor of each punching tool corresponding to the punching size and type of said punching tools in said upper turret;

control signal generating means receiving said data in said data tables and calculating the minimum hydraulic pressure in said hydraulic cylinder required to completely execute all of said punching operations in said program and generating a corresponding pump pressure control signal;

pump pressure control means responsive to said control signal causing the output pressure of said pump to be adjusted to a constant minimum output pressure in correspondence to the level of said control signal throughout the course of execution of said punching program, whereby said pump output pressure is adjusted to be maintained at a constant pressure level lower than said maximum pump output pressure during each of the punching operations of a punching program not requiring said maximum pump output pressure.

2. The punch press according to claim 1 wherein said control signal generating means utilizes the following algorithm to calculate the minimum hydraulic pressure required to completely execute said punching program and generating said pump pressure control signal:

$$P=[(c \cdot t \cdot r \cdot s)/A]+pa$$

where P=minimum system hydraulic pressure required during complete execution of said punching operation program;

c=circumference of the punch tool;

t=material thickness;

r=material shear strength;

s=punching tool shear factor;

A=area of the ram cylinder;

pa=system pressure loss factor

3. The punch press according to claim 2 wherein said storage tables include data on a range of material thicknesses and shear strengths and punching tool shear factors to be used on said press, and said program contains a selected material thickness and shear strength and punch tool configuration from said range of data.

* * * * *

UNITED STATES PATENT AND TRADEMARK OFFICE

CERTIFICATE OF CORRECTION

PATENT NO. : 5,390,574

DATED : February 21, 1995

INVENTOR(S) : Gerard J. Schorn

It is certified that error appears in the above-identified patent and that said Letters Patent is hereby corrected as shown below:

On the title page, after item [76] insert the following:

-- [73] Assignee: Murata Machinery, Ltd.
Kyoto, Japan --.

Signed and Sealed this

Ninth Day of May, 1995

Bruce Lehman

*Attest:*

BRUCE LEHMAN

*Attesting Officer*

*Commissioner of Patents and Trademarks*